US009347409B2

(12) United States Patent
Dölker

(10) Patent No.: US 9,347,409 B2
(45) Date of Patent: May 24, 2016

(54) METHOD FOR CONTROLLING AND REGULATING AN INTERNAL COMBUSTION ENGINE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 255 days.

(21) Appl. No.: 14/115,188

(22) PCT Filed: Apr. 27, 2012

(86) PCT No.: PCT/EP2012/001815

§ 371 (c)(1),
(2), (4) Date: Jan. 10, 2014

(87) PCT Pub. No.: WO2012/150020

PCT Pub. Date: Nov. 8, 2012

(65) Prior Publication Data

US 2014/0123950 A1 May 8, 2014

(30) Foreign Application Priority Data

May 2, 2011 (DE) ..... 10 2011 100 187

(51) Int. Cl.
*F02M 1/00* (2006.01)
*F02M 41/16* (2006.01)
(Continued)

(52) U.S. Cl.
CPC ..... *F02M 41/16* (2013.01); *F02D 41/221* (2013.01); *F02D 41/3863* (2013.01);
(Continued)

(58) Field of Classification Search
CPC ..... F02M 55/025; F02D 2001/0085
USPC ..... 123/456, 459–463, 478, 480, 457
See application file for complete search history.

(56) References Cited

U.S. PATENT DOCUMENTS 7,451,038 B2 11/2008 Kosiedowski et al.
7,610,901 B2 11/2009 Bucher et al.
(Continued)

FOREIGN PATENT DOCUMENTS

DE 19937962 A1 2/2001
DE 102006040441 B3 2/2008
(Continued)

OTHER PUBLICATIONS

PCT International Search Report dated Aug. 27, 2012 for PCT/EP2012/001815.
(Continued)

*Primary Examiner* — John Kwon
(74) *Attorney, Agent, or Firm* — Reising Ethington P.C.

(57) ABSTRACT

Proposed is a method for controlling and regulating an internal combustion engine (1) having a common rail system and having a passive pressure limiting valve (11) for discharging fuel out of a rail (6) into the fuel tank (2), in which method, in a first stage, the pressure limiting valve (11) is set as open when the rail pressure, proceeding from a steady-state rail pressure, exceeds a first threshold value and subsequently falls below a second threshold value within a first critical time, wherein the first threshold value characterizes a higher pressure level than the steady-state rail pressure and the second threshold value characterizes a lower pressure level than the first threshold value, and in which method the opening duration of the opened pressure limiting valve (11) is monitored.

17 Claims, 9 Drawing Sheets

(51) Int. Cl.
*F02D 41/22* (2006.01)
*F02D 41/38* (2006.01)
*F02M 63/00* (2006.01)

(52) U.S. Cl.
CPC .... *F02D 2041/224* (2013.01); *F02D 2041/227* (2013.01); *F02D 2041/228* (2013.01); *F02D 2250/31* (2013.01); *F02M 63/005* (2013.01)

(56) References Cited

U.S. PATENT DOCUMENTS

2002/0100458 A1* 8/2002 Hafner ..... F02D 41/1498 123/480
2004/0020463 A1* 2/2004 Anderson ..... F04B 49/225 123/446
2008/0092852 A1* 4/2008 Bucher ..... F02D 41/221 123/457
2009/0223488 A1* 9/2009 Dolker ..... F02D 41/3845 123/456
2011/0093183 A1* 4/2011 Veit ..... F02D 41/2464 701/103
2011/0220066 A1* 9/2011 Dolker ..... F02D 41/3845 123/458
2011/0231080 A1* 9/2011 Dolker ..... F02D 41/3863 701/103
2012/0221226 A1 8/2012 Dolker

FOREIGN PATENT DOCUMENTS

DE 102006049266 B3 3/2008
DE 102009050468 A1 4/2011

OTHER PUBLICATIONS

English language abstract of DE-19937962.

* cited by examiner

METHOD FOR CONTROLLING AND REGULATING AN INTERNAL COMBUSTION ENGINE

CROSS REFERENCE TO RELATED APPLICATIONS

This application is a National Phase Application related to PCT/EP2012/001815 filed on Apr. 27, 2012, which application claims priority to DE 10 2011 100 187.9 filed on May 2, 2011, which applications are incorporated herein by reference in their entirety.

TECHNICAL FIELD

The present disclosure relates to a method for controlling and regulating an internal combustion engine having a common rail system and having a passive pressure limiting valve for discharging fuel out of a rail into the fuel tank, by means of which method the pressure limiting valve may be monitored.

BACKGROUND

In one known method, a passive pressure limiting valve is monitored for opening. An open pressure limiting valve is detected according to a load shedding, in that the rail pressure exceeds a threshold value, subsequently a steady-state status of the combustion engine is detected, and supplementally a characteristic value of the rail pressure control loop deviates significantly from a reference value. The integral portion of the rail pressure regulator and, for example, a PWM signal for controlling the suction throttle are understood as characteristic values of the rail pressure control loop.

In a second known approach, a method is provided for monitoring a passive pressure limitation valve according to a load shedding. In a first stage, proceeding from a steady-state rail pressure, for example 1800 bar, it checks whether the rail pressure has exceeded a first, higher threshold value, for example 1850 bar. In a second stage, it then checks whether the rail pressure has exceeded a second, still higher threshold value, for example 1920 bar, despite a temporary increase in the control signal for the suction throttle. If both threshold values have been exceeded, then the pressure limiting valve is set as open. Based on the control of the pressure limiting valve, the case can indeed occur in practice that the pressure limiting valve is indeed detected as open by the evaluation program, however, it is still actually closed. The consequence is an operator false alarm and an erroneous follow-up response.

In one aspect of the second approach described above, a method is provided which checks whether the rail pressure has exceeded the second threshold value and subsequently fallen below a further threshold value having a lower pressure level than the second threshold value. Having fallen below the further threshold value, the rail pressure control deviation is then monitored for a predetermined time period. If the rail pressure control deviation is constantly greater than, for example, 20 bar during this time period, then, upon expiration of the time, the pressure limiting valve is set as open. It is critical that a pressure limiting valve can tend towards leakage once it has been opened and can cause undesired leakage during normal operation. The leakage corresponds to that fuel volume flow which discharges undesirably into the fuel tank via the pressure limiting valve. In turn, the leakage also affects a decreasing total efficiency, as the high-pressure pump must convey more fuel into the rail so that the rail pressure is achieved. In the advanced stage, the high-pressure pump can no longer maintain the set rail pressure, that means, the engine output drops and the exhaust values deteriorate with a clearly visible opacity.

SUMMARY

One aspect of the exemplary illustrations described herein is to detect an actually opened pressure limiting valve for a conventional common rail system and to determine a handling recommendation.

The problem is addressed by claim 1. Other exemplary approaches are presented in the dependent claims.

According to one exemplary approach, in a first stage, the pressure limiting valve is set as open if, within a first critical time, proceeding from a steady-state rail pressure, the rail pressure exceeds a first threshold value and subsequently falls below a second threshold value. The first threshold value is characterized by a higher pressure level than the steady-state rail pressure, and the second threshold value is characterized by a lower pressure level than the first threshold value. Supplementally, the opening duration of the pressure limiting valve is then monitored, in that upon setting an open pressure limiting valve, a first time limit, for example three hours, and a second time limit, for example five hours, for further operation, are determined. Upon timeout of the first time limit, a yellow alarm is initiated to warn the operator, and after timeout of the second time limit, a red alarm is initiated as a recommendation to replace the pressure limiting valve. The underlying rational for this solution is that the operating duration for the open pressure limiting valve is decisive for the evaluation as to whether the pressure limiting valve is still leak-proof after restarting, or already tends toward leaking.

If a manual engine stop is triggered by the operator, then the opening duration is stored upon detection of the stopped internal combustion engine. Following a restart of the internal combustion engine, the saved opening duration then continues to be counted, if the pressure limiting valve is again set as open during normal operation and the opening duration thereof is monitored.

The first stage of the monitoring of the overpressure valve already offers a safe method for detecting an open overpressure valve. The simple parameterization and implementation of the method are the most important advantages. The only measurement required is which rail pressure is set as the maximum in the case of an open overpressure valve. This is the case during maximum engine speed and minimum load. The second threshold value must then be selected as somewhat greater than this resulting rail pressure value. The first critical time can likewise be easily parameterized, in that an opening procedure is designated and the time is measured from exceeding the first threshold value and from falling below the second threshold value. Since a pressure drop that is caused by a control process, e.g. by load shedding, lasts significantly long, a sufficient buffer time can also be considered. The simple parameterization becomes especially clear in comparison to a method in which the rail pressure gradient is evaluated. In this case, the type of gradient calculation, among others, is very important, since the maximum negative rail pressure gradient is determined and must be compared to the maximum negative rail pressure gradient in controlled operation, in order to obtain a criterion for detecting an open overpressure valve.

A safety advantage can be achieved in that the single-stage method can be supplemented by a second stage, which is used as a further criterion in addition to the rail pressure control deviation. Specifically, an exemplary method may include setting the pressure limiting valve as open if, after a positively detected first stage, an uninterrupted absolute value of the rail pressure control deviation greater than/equal to a threshold value was detected within a second critical time in the second stage. Therefore, the operator can be alerted in time when the overpressure valve becomes leaky. The operator can thereby replace the pressure limiting valve in time, before an output drop occurs in the internal combustion engine or a deterioration of emissions occurs or black smoke formation occurs, caused by a leaky pressure limiting valve.

In addition to the opening duration, the frequency of the opening procedures may also be supplementally detected. Thus, a yellow alarm is initiated for a first number of opening procedures, and a red alarm is initiated for a second number of opening procedures. The rationale underlying this solution is also the fact that, in addition to the operating duration with an open pressure limiting valve, the number of opening procedures is also decisive for the evaluation as to whether the pressure limiting valve is still leak-proof after restarting or already tends toward leaking.

BRIEF DESCRIPTION OF THE DRAWINGS

Exemplary illustrations are described in further detail below, with reference to the figures. As seen in.

DETAILED DESCRIPTION

Figure 1:
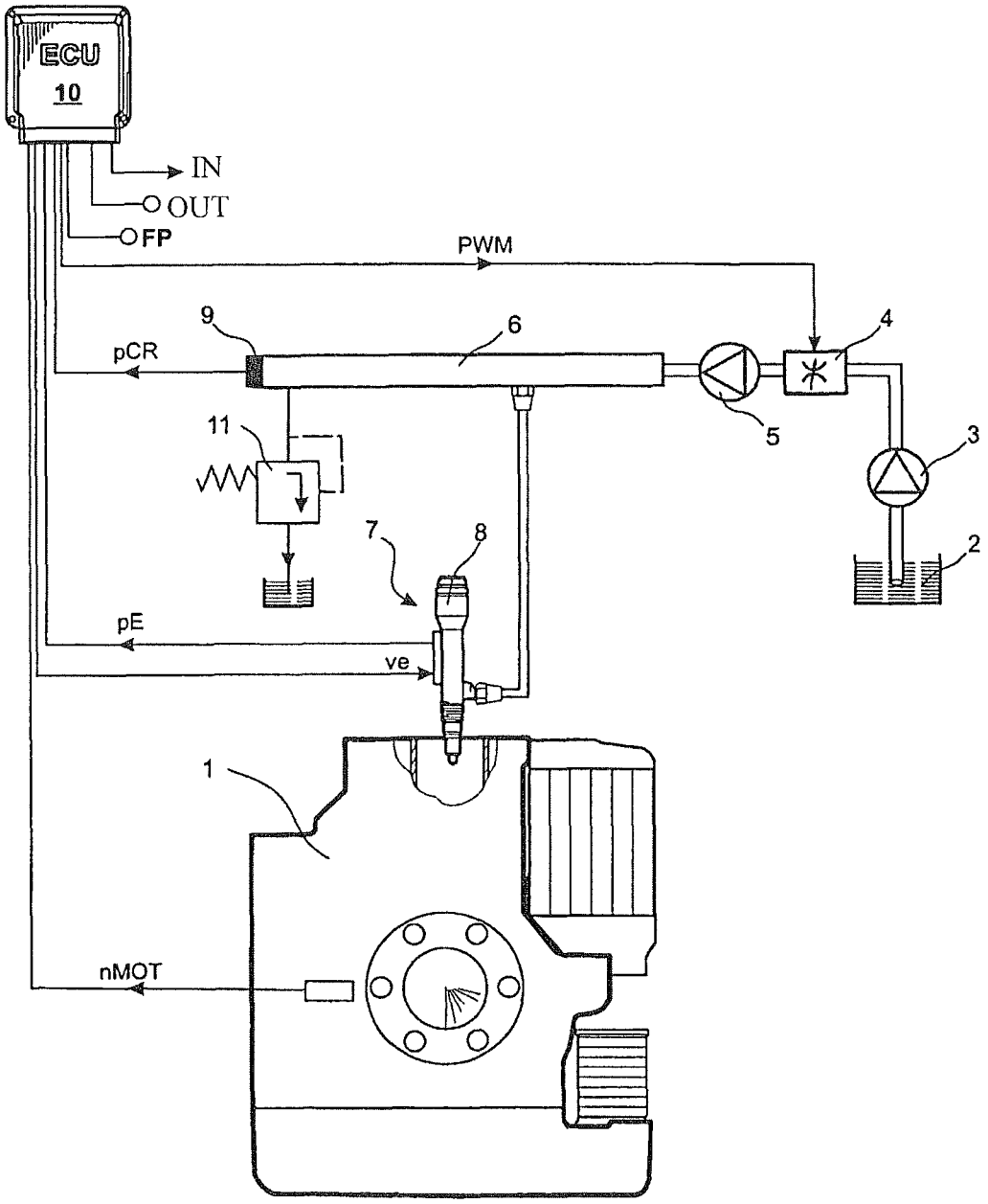
FIG. 1 a system diagram, according to an exemplary illustration.

FIG. 1 shows an exemplary system diagram of an electronically controlled internal combustion engine 1 having a common rail system. The common rail system may include the following mechanical components: a low-pressure pump 3 for conveying fuel from a fuel tank 2, an adjustable suction throttle 4 for influencing the through flowing fuel volume flow, a high-pressure pump 5 for conveying the fuel under increased pressure, a rail 6 for storing the fuel, and injectors 7 for injecting the fuel into the combustion chambers of the internal combustion engine 1. The common rail system may also be implemented with individual storage chambers, wherein for example an individual storage chamber 8 as additional buffer volume is then integrated in the injector 7. A passive pressure limiting valve 11 is provided as protection from an unacceptably high pressure level in the rail 6, which pressure limiting valve opens, for example at a rail pressure of 2400 bar, and in the open state discharges the fuel out of the rail 6 into the fuel tank 2.

The operating mode of the internal combustion engine 1 is determined by an electronic control unit (ECU) 10. The electronic control unit 10 contains the conventional components for a microcomputer system, for example, a microprocessor, I/O modules, buffer and memory components (EEPROM, RAM). Operating data relevant for the operation of the internal combustion engine 1 is applied in characteristic maps/characteristic curves in the memory components. Using said characteristic maps/characteristic curves, the electronic control unit 10 calculates the output variables from the input variables. In FIG. 1, the following input variables are depicted as an example: the rail pressure pCR which is measured using a rail pressure sensor 9, an engine speed nMOT, a signal FP for planned performance by the operator, optionally the individual storage pressure pE, and an input variable IN. The additional sensor signals are collected using the input variable IN, for example the charge air pressure of an exhaust gas turbocharger. In FIG. 1, a signal PWM for controlling the suction throttle 4, a signal ve for controlling the injectors 7 (injection start/injection end), and an output variable OUT are depicted as output variables of the electronic control unit 10. The output variable OUT representatively stands for the additional control signals for controlling and regulating the internal combustion engine 1, for example for a control signal to activate a second exhaust gas turbocharger for a sequential turbocharger.

Figure 2:
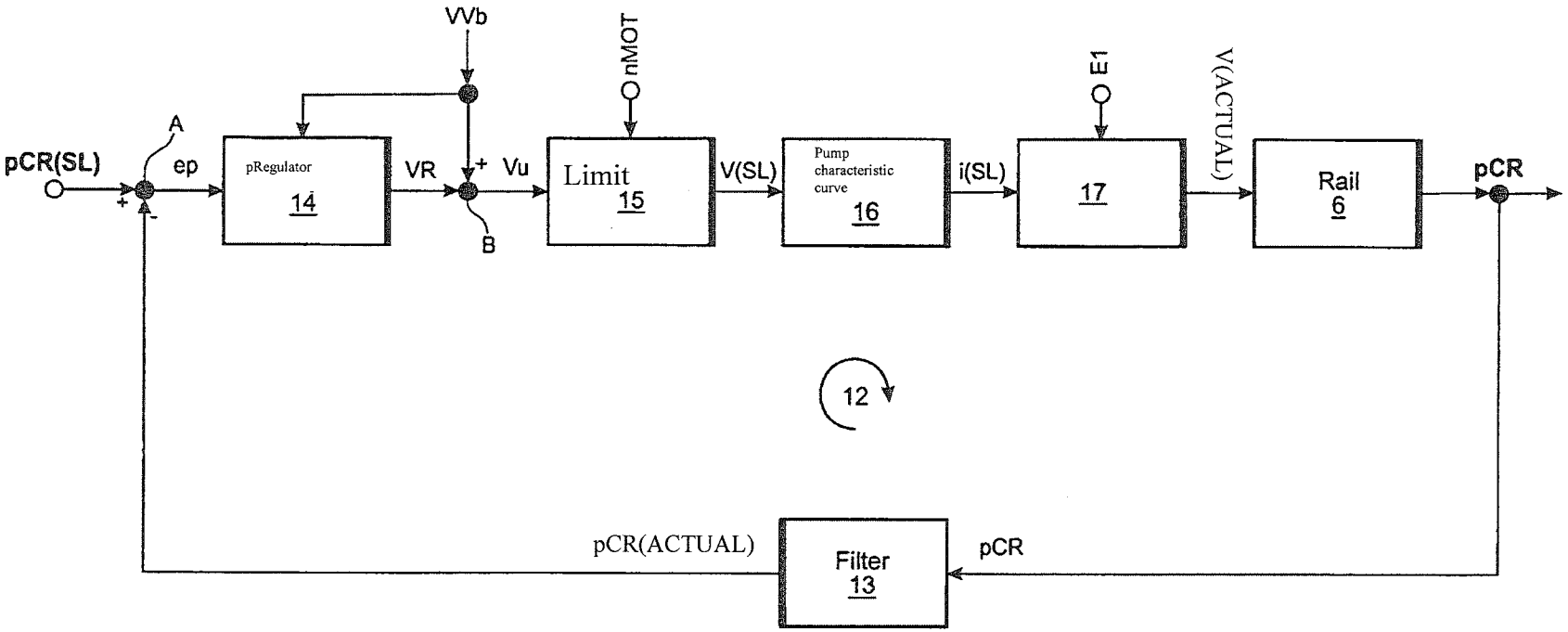
FIG. 2 a rail pressure control loop, according to one exemplary approach.

FIG. 2 shows an exemplary rail pressure control loop 12 for regulating the rail pressure pCR. Input variables for the rail pressure control loop 12 may include: a target rail pressure pCR(SL), a target consumption VVb, the engine speed nMOT, and a variable E1. For example, the PWM base frequency, the battery voltage, and the ohmic resistance of the suction throttle coil with feedline are collected under the variable E1, which is entered into the calculation of the PWM signal. The output variable of the rail pressure control loop 12 is the raw value of the rail pressure pCR. The actual rail pressure pCR(ACTUAL) is calculated from the raw value of the rail pressure pCR by means of a filter 13. This actual rail pressure is then compared with the target rail pressure pCR (SL) at a summation point A, from which a control deviation ep results. A pressure regulator 14 calculates the set variable thereof from the control deviation ep, which set variable corresponds to a controller-volume flow VR with the physical units of liters/minute. The calculated target consumption VVb is added to the controller-volume flow VR at a summation point B. The target consumption VVb is calculated depending on a target injection amount and the engine speed. The result of the addition at the summation point B corresponds to an unlimited volume flow Vu, which is limited via a limit 15 depending on the engine speed nMOT. The output variable of the limit 15 corresponds to a set volume flow V(SL), which is the input variable for a pump characteristic curve 16. Using the pump characteristic curve 16, an electrical target current i(SL) is assigned to the target volume flow V(SL). The target current i(SL) is an input variable of a function block 17. The calculation of the PWM is obtained in function block 17. The output variable of function block 17 corresponds to the actual volume flow V(ACTUAL), which is conveyed from the high-pressure pump into the rail 6. The pressure level pCR in the rail is detected by the rail pressure sensor. This closes the control loop 12.

Figure 3:
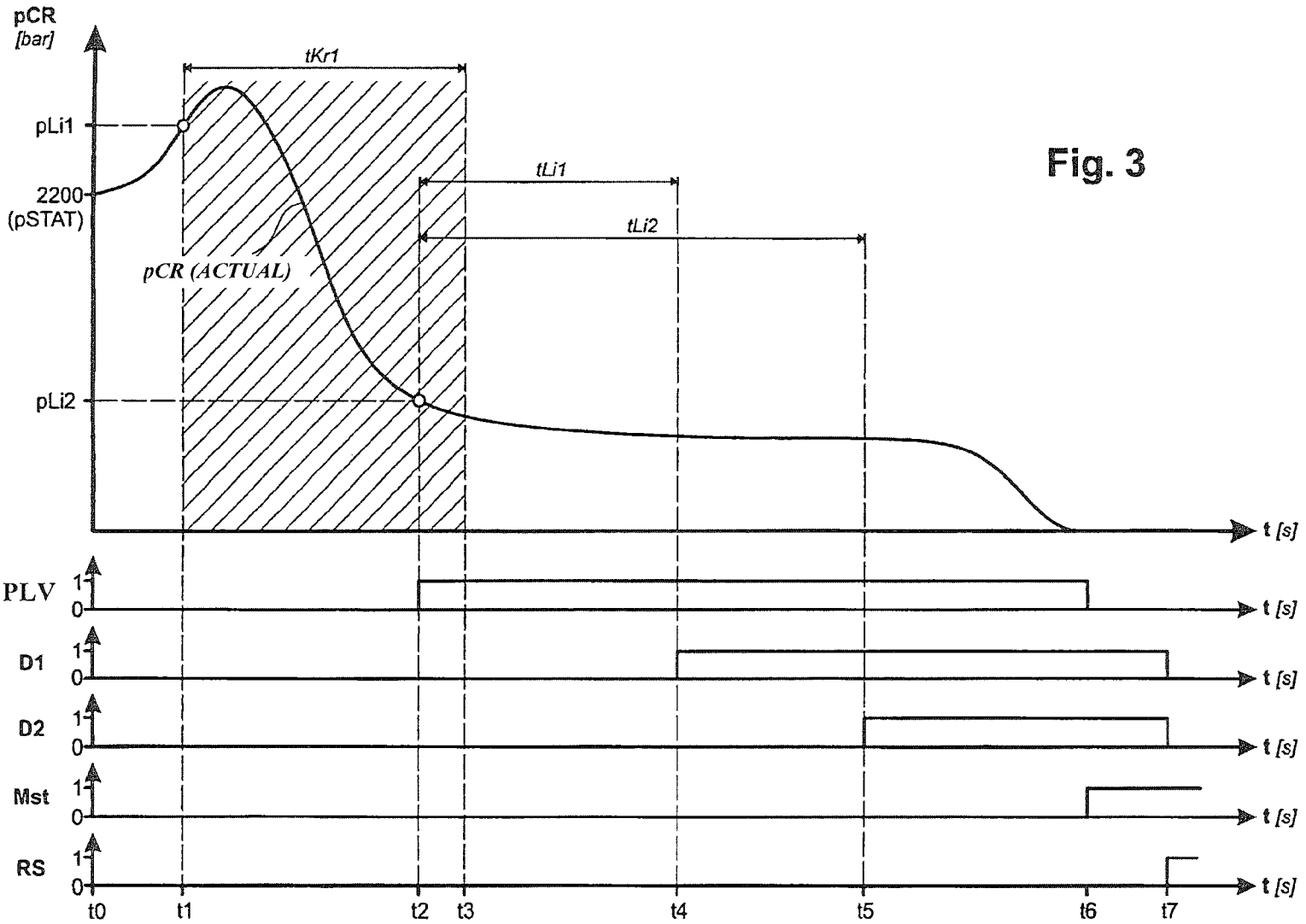
FIG. 3 a single-stage method in a timing diagram, according to an exemplary illustration, FIG. 4 a two-stage method in a timing diagram, according to one exemplary approach, FIG. 5 multiple opening procedures in a timing diagram, according to an exemplary illustration, FIG. 6 a program flow chart, according to one exemplary approach, FIG. 7 a first subroutine, according to an exemplary illustration, FIG. 8 a second subroutine, according to one exemplary approach, and FIG. 9 a third subroutine, according to an exemplary illustration.

FIG. 3 shows, in a timing diagram, the single-stage method for detecting an opening procedure of the pressure limiting valve with monitoring of the open time, according to one exemplary approach. The following are depicted over time: the rail pressure pCR, a process variable PLV as status indication of the pressure limiting valve, a process variable D1 for the yellow alarm, a process variable D2 for the red alarm, a process variable engine stop Mst for a stationary internal combustion engine and a signal RS as a reset signal.

At time t0, the rail pressure pCR corresponds to the steady-state rail pressure pSTAT=2200 bar. After this time, triggered, e.g., by a wire break for the suction throttle and thus a completely open suction throttle, an increase in the rail pressure occurs. At time t1, the rail pressure pCR reaches the first threshold value pLi1. At time t1, a first critical time tKr1 begins to run, which ends at time t3. If, within the first critical time tKr1, a drop of the rail pressure pCR occurs to at least a second threshold value pLi2, then an open pressure limiting valve is detected. This is the case in FIG. 3 at time t2; the process variable PLV changes from a value of 0 to a value of 1, which means that the pressure limiting valve is set as open (PLV=1). The first threshold value pLi1 is, e.g. set to the value pLi1=2320 bar. The second threshold value pLi2 must be set such that the rail pressure pCR at an open pressure limiting valve drops to a level lower than the second threshold value pLi2 for all operating points. In practice, the second threshold value pLi2 can e.g. take on the value pLi2=1000 bar. During test block tests, it was determined that the drop of the rail pressure pCR from the first threshold value pLi1 to the second threshold value pLi2 in the case of an open pressure limiting valve takes place within a timespan of approximately 0.2 seconds. The first critical time tKr1 can therefore be set e.g. to the value tKr1=0.5 seconds.

Upon detection of an open pressure limiting valve, the monitoring of the open time starts at time t2. If the pressure limiting valve is operated in a open state during a first time limit tLi1, then upon timeout of the first time limit tLi1, for example tLi1=3 hours, a yellow alarm is triggered. This is the case at time t4. The process variable D1 changes from a value of 0 to a value of 1. The operator is warned via the yellow alarm. If the pressure limiting valve is also operated in an open state during the second time limit tLi2, for example tLi2=5 hours, then a red alarm is triggered upon timeout of the second time limit tLi2. This is the case at time t5. The process variable D2 changes from a value of 0 to a value of 1. The internal combustion engine is subsequently turned off by the operator, so that at time t6, an engine stop is detected. The process variable Mst (engine stop) thereby changes from a value of 0 to a value of 1. The pressure limiting valve is now closed, the process variable PLV changes from a value of 1 to a value of 0. The pressure limiting valve should now be replaced by a new valve. If this is carried out, then at time t7, the reset button is pressed, by which means the RS signal changes from a value of 0 to a value of 1. By this means, the alarms are reset, i.e. the two process variables D1 (yellow alarm) and D2 (red alarm) are reset again to a value of 0. The monitoring of the pressure limiting valve can now restart again.

If the internal combustion engine is turned off before the opening time of the first time limit tLi1, or has exceeded the second time limit tLi2, then the current opening time is stored upon detecting the engine stop. If, following a restart of the internal combustion engine at a later time, an open pressure limiting valve is detected again, then the stored opening time is recounted and monitored for limit violation. Safety is increased by these measures, in that an undesired leakage in normal operation due to a previously opened pressure limiting valve is prevented.

Figure 4:
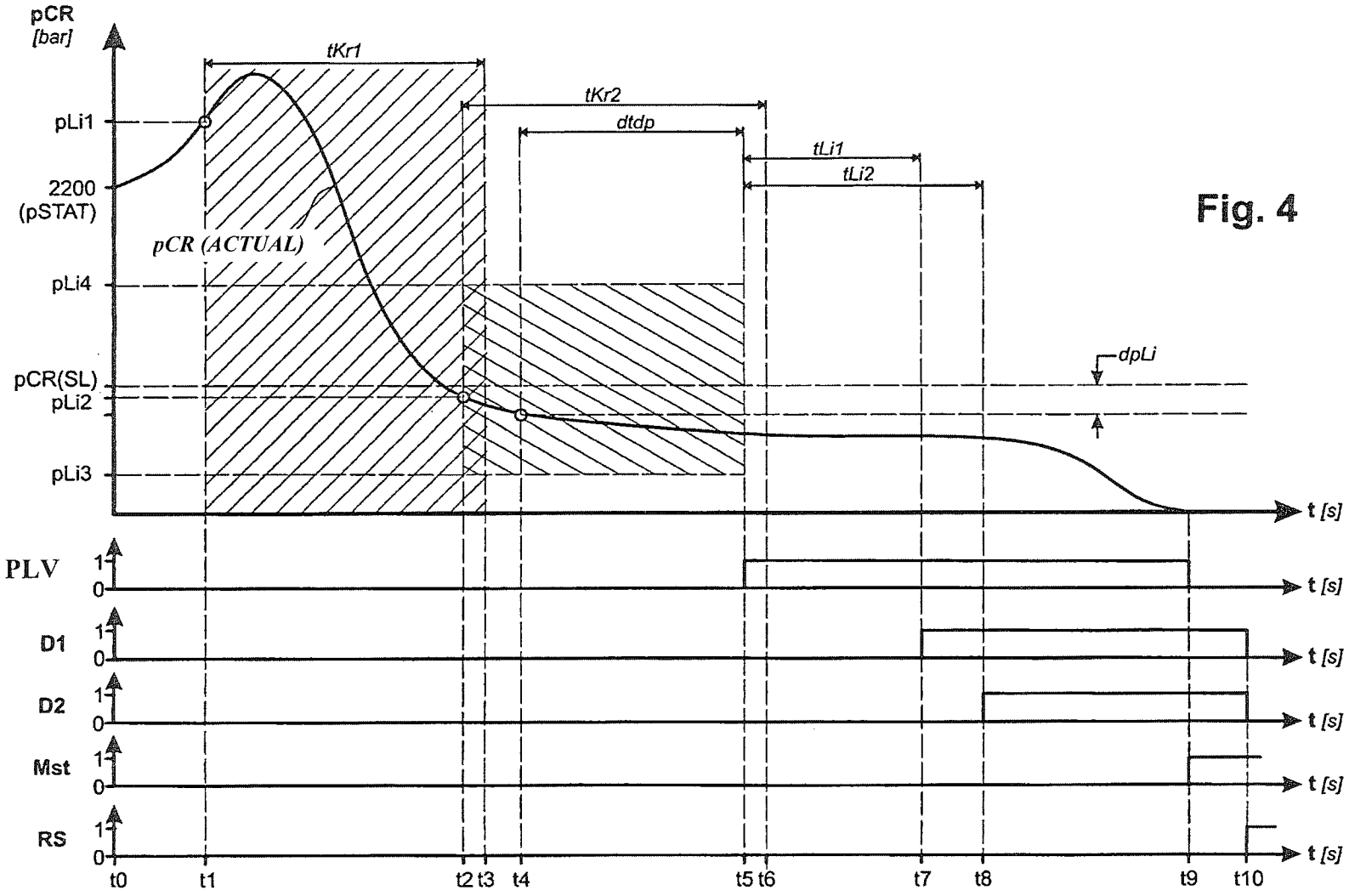

FIG. 4 shows in a timing diagram the two-stage method for detecting the opening procedure of the pressure limiting valve with monitoring of the opening time. The following are depicted over time: the rail pressure pCR, a process variable PLV as status indication of the pressure limiting valve, the process variable D1 for the yellow alarm, the process variable D2 for the red alarm, the process variable engine stop Mst for a stationary internal combustion engine, and the signal RS as a reset signal.

The process in the time frame t0 to t3 corresponds to that of FIG. 3. In order to detect an open pressure limiting valve, the rail pressure pCR must again reach or fall below the second threshold value pLi2 after reaching the first threshold value pLi1 within the first critical time tKr1. If this is the case, then the absolute value of the rail pressure control deviation must be steadily greater than or equal to a threshold value dpLi within a second critical time tKr2 during the time dtdp. At the same time, the rail pressure may not fall below a third threshold pLi3 and may not exceed a fourth threshold value pLi4, and no engine stop may be detected. If all these conditions are satisfied, then an open pressure limiting valve is detected. This is the case at time t5. The process variable PLV now takes on a value of 1. The additional process corresponds to the single-stage method of FIG. 3, which means, beginning at time t5, the first time limit tLi1 and the second time limit tLi2 are set. Upon timeout of the first time limit tLi1, a yellow alarm is initiated. Correspondingly, a value of the process variable D1 changes from 0 to 1. This is the case at time t7. Upon timeout of the second time limit tLi2, a red alarm is initiated. Correspondingly, a value of the process variable D2 changes from 0 to 1. This is the case at time t8. At time t9, an engine stop is detected, i.e. the signal Mst (engine stop) changes from a value of 0 to a value of 1. The pressure limiting valve is now closed again, so that the process variable PLV is changed from a value of 1 to a value of 0. At time t10, the reset RS is activated, which has as a consequence that the alarms are reset, i.e. the signals D1 and D2 are reset from a value of 1 to a value of 0.

Figure 5:
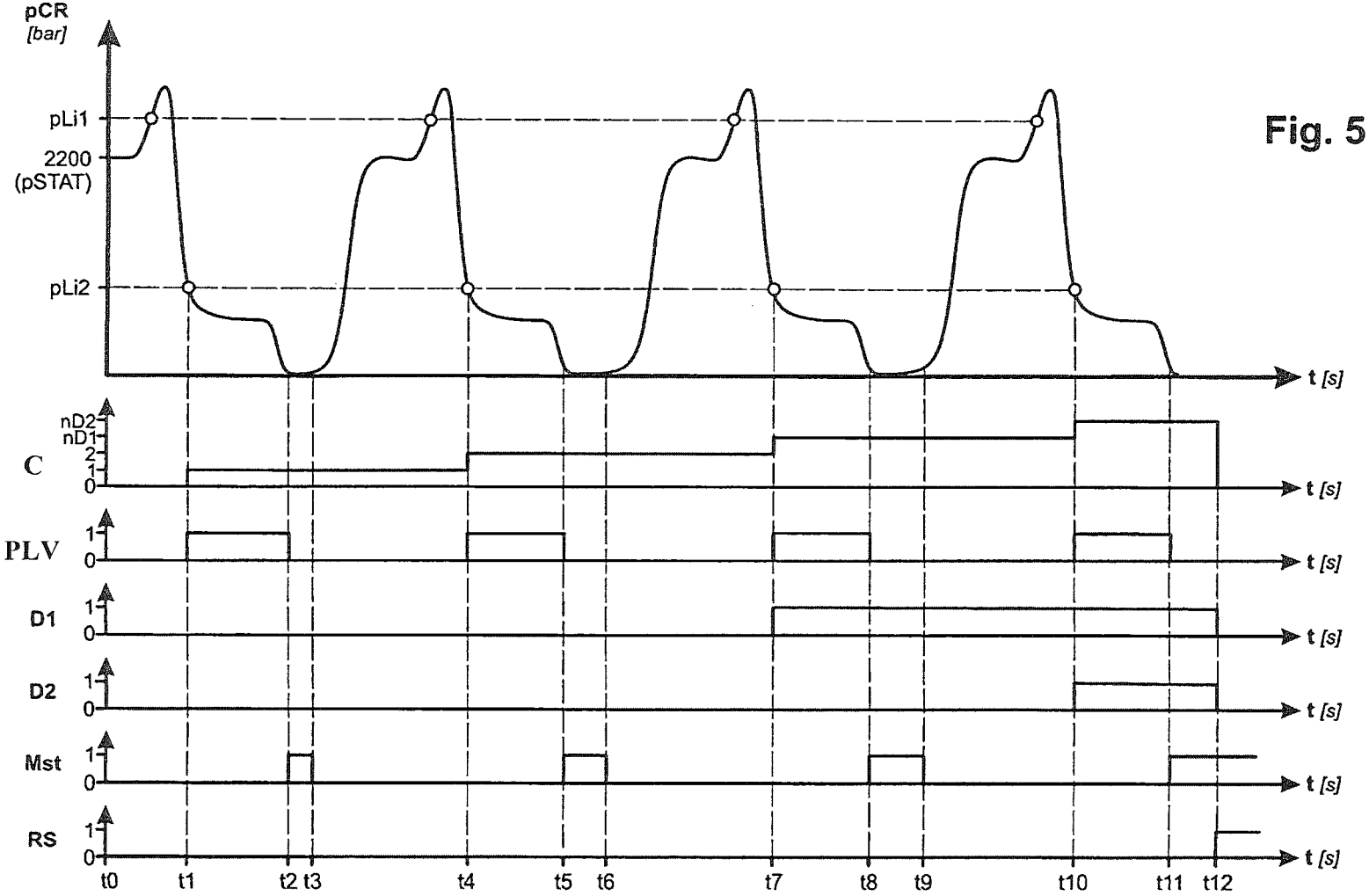

FIG. 5 shows an exemplary method, in which the number of opening procedures is monitored in addition to the opening time of the pressure limiting valve. For the individual opening procedures, the single-stage method (FIG. 3) can be used as well as the two-stage method (FIG. 4). Due to reasons of clarity, the times (tKr1, tKr2, tLi1, tLi2, etc.) are left out of FIG. 5. The following are depicted over time: the rail pressure pCR, a counter C, the process variable PLV as status indication of the pressure limiting valve, the process variable D1 for the yellow alarm, the process variable D2 for the red alarm, the process variable engine stop Mst for a stationary internal combustion engine, and the signal RS as a reset signal.

At time t1, an open pressure limiting valve is detected after the rail pressure pCR first exceeded the first threshold pLi1 and subsequently fell below the second threshold pLi2. The signal PLV changes from a value of 0 to a value of 1. The number of opening procedures is counted and stored in the counter C. Since at the time t1, the first opening procedure is detected, the counter status changes from a value of 0 to a value of 1. The internal combustion engine is now turned off. At time t2, the engine stop is detected, i.e. the signal Mst (engine stop) changes from a value of 0 to a value of 1. The signal PLV is reset. The internal combustion engine is now restated, so that at time t3 a running internal combustion engine is detected. This means that the signal Mst (engine stop) is reset at this time. At time t4, an open overpressure valve is detected for a second time. The counter C is incrementally increased to the value two. The variable PLV simultaneously takes on a value of 1 again. The internal combustion engine is turned off again, so that at time t5 an engine stop is detected, i.e. the variable engine stop Mst is set to a value of 1 again. The variable PLV is reset to a value of 0. In the following, the number of opening procedures is further counted, i.e. the counter C is incremented at each additional opening procedure. If the pressure limiting valve has opened a total of nD1 times, for example 30 times, then a yellow alarm is triggered, i.e. in this case the variable D1 changes from a value of 0 to a value of 1 (time t7). If the overpressure valve has finally opened nD2 times, for example 50 times, then a red alarm is triggered at time t10. At time t11, an engine stop is detected, the variable Mst is set to a value of 1. At the latest, a replacement of the pressure limiting valve should take place at the current time. If this replacement is carried out, then the reset RS is triggered at time t12, by which means the two alarms D1 and D2 are reset to a value of 0. The counter C, which describes the number of opening procedures, is likewise reset to a value of 0. By this means, the monitoring of the pressure limiting valve can now start anew.

Figure 6:
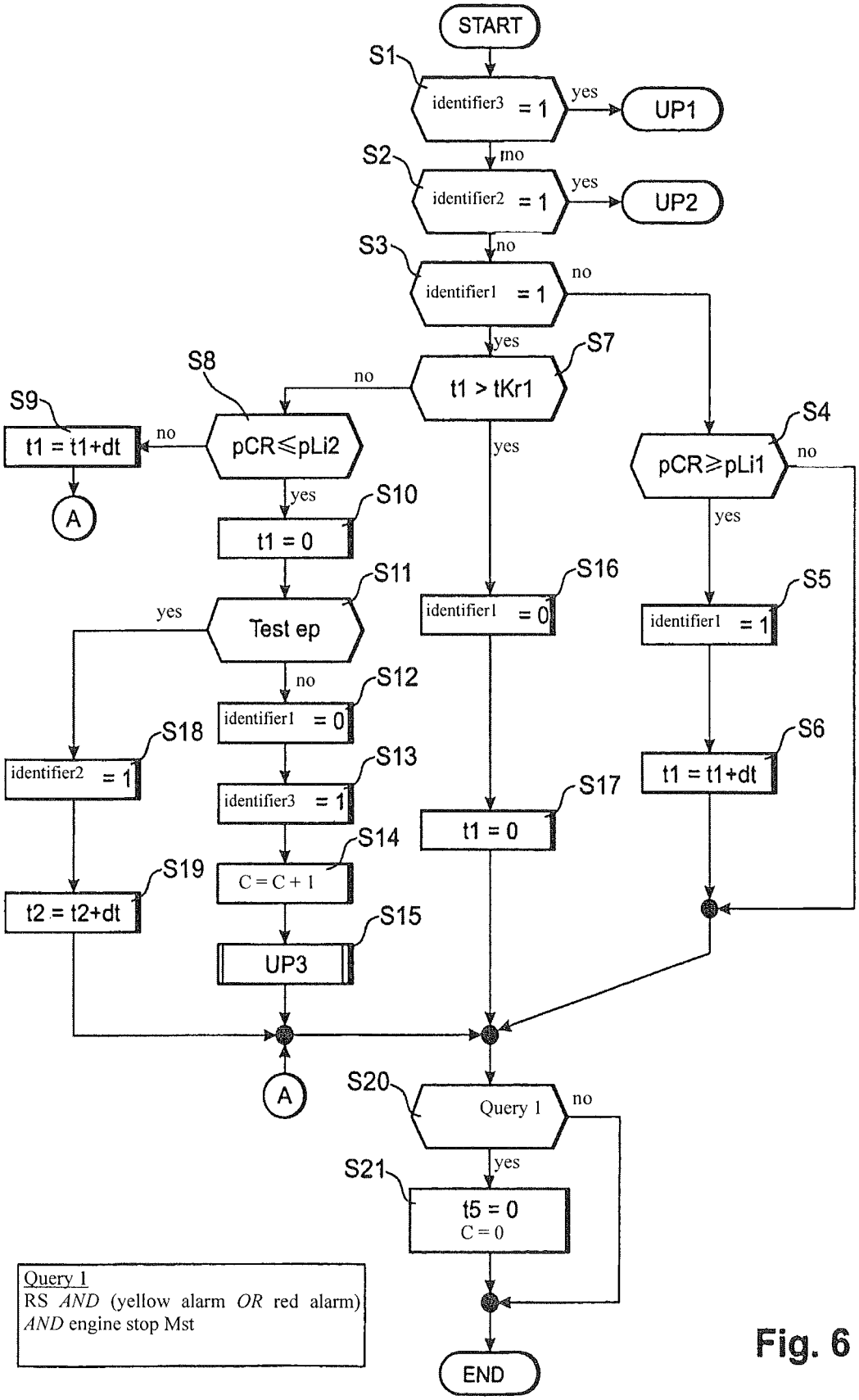

FIG. 6 shows a program flow chart for monitoring the pressure limiting valve, according to an exemplary illustration. At S1, the identifier3 is queried. The identifier3 is then set if the pressure limiting valve is already open (identifier3=1). If this is the case (i.e., query result S1:yes), then the program branches into a first subroutine UP1, which is explained further below in connection with FIG. 7. Otherwise, at S2 a identifier2 is queried. Identifier2 is then set (identifier2=1) if the two-stage method is used and the single-stage method has already run through successfully. If this is the case (i.e., query result S2:yes), then the program branches into a second subroutine UP2, which is explained further below in connection with FIG. 8. Otherwise, at S3 a value of identifier1 is queried. The identifier1 is then set (identifier)=1) if a first threshold value pLi1 has already been reached. The first threshold value pLi1 characterizes a higher pressure level than the steady-state rail pressure pSTAT. Typical values are for the steady-state rail pressure pSTAT=2200 bar and for the first threshold value pLi1=2320 bar. If identifier1 is not yet set (i.e., query result S3:no), then the program checks at S4 whether the rail pressure pCR has reached or exceeded the first threshold value pLi1. If this is not the case (i.e., query result S4:no), then the program continues to run at S20. Otherwise, at S5 the identifier1 is set to a value of 1 (identifier)=1) and at S6 a time t1 is incremented. Afterwards, the program is continued at S20.

If the check at S3 results in that identifier1 is set (i.e., query result S3:yes), then at S7 the time t1 is compared with a first critical time tKr1. This time t1 serves to check whether the second threshold value pLi2 has been reached or underrun within the first critical time tKr1. If time t1 is greater than the critical time tKr1 (i.e., query result S7:yes), then the identifier1 and the time t1 are reset to values of 0 at S16 and S17, respectively. Afterwards, the program continues at S20. If the first critical time tKr1 was not exceeded by time t1 (i.e., query result S7:no), then the program checks at S8 whether the rail pressure pCR has reached or fallen below a second threshold value pLi2. In one example, a typical value for the second threshold value is pLi2=1000 bar. If this is not the case, then at S9 the time t1 is incremented and the program course is continued at point A. If it was determined at S8 that the rail pressure pCR has reached or fallen below the second threshold value pLi2, then the time t1 is reset to a value t1=0 at S10. The first stage of the monitoring method is thus concluded.

Now at S11 the program checks whether the monitoring method should be implemented in two stages. If the second stage is set (i.e., query result S11:yes), then at S18 the identifier2 is set to a value of 1 and at S19 the time t2 is incremented. This time t2 serves to check whether a rail pressure control deviation ep was steadily present within a second critical time tKr2 during a timeframe dtdp, which absolute value of the control deviation dp is greater than or the same as the threshold value dpLi. If only the single-stage monitoring method is set (i.e., query result S11:no), then at S12 the identifier1 is reset to the value identifier1=0 and at S13 the identifier3 is set to the value identifier3=1, i.e. in this case an open pressure limiting valve is detected. Subsequently, at S14 the counter C, which indicates how often the pressure limiting valve has opened, is incremented. At S15, in a third subroutine UP3, the counter status is queried. The third subroutine UP3 is explained further below in connection with FIG. 9. Afterwards, the program continues at S20. At S20, the following conditions are checked in a query 1: was the reset signal RS output, i.e. was the pressure limiting valve replaced, and did a yellow alarm or a red alarm take place, and is the engine stopped (Mst=1). If this query is negative, then the program is ended. If the query is positive (i.e., query result S20:yes), then at S21, a time t5 is set and the counter C is set to zero. Then the program may then be ended.

Figure 7:
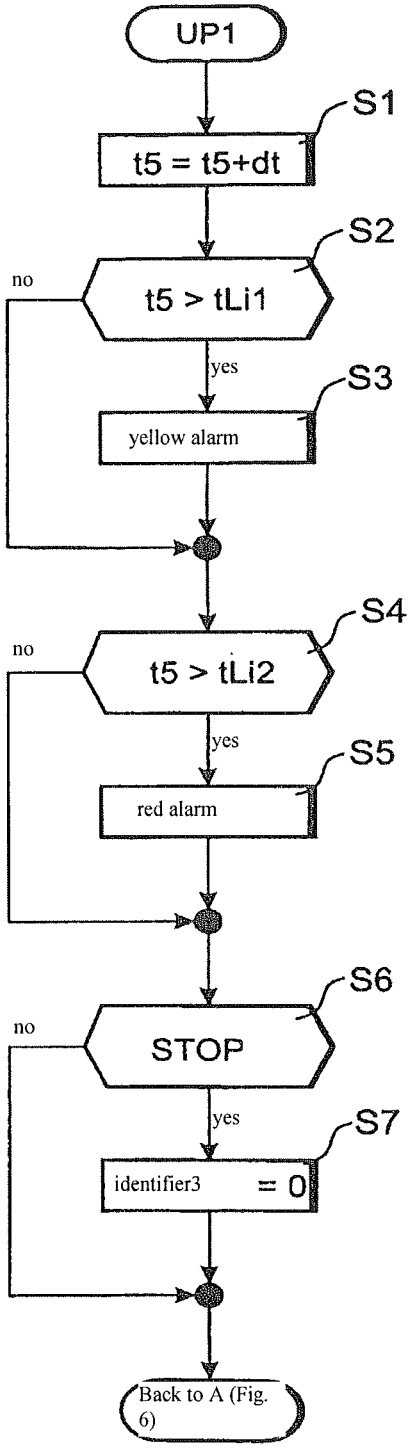

The first subroutine UP1 is depicted in FIG. 7, in an exemplary illustration. The opening duration of the pressure limiting valve may be detected using the first subroutine UP1. The first subroutine UP1 may be called up, e.g., when it is determined in the main program of FIG. 6 at S1 that the identifier3 is set (identifier3=1), thus that the pressure limiting valve is already open. At S1, a time t5 is incremented and the program checks at S2 whether the time t5 has already exceeded the first time limit tLi1. If this is not the case (i.e., query result S2:no), then the program continues at S4. If the first time limit tLi1 was exceeded, then at S3 a yellow alarm is output as a warning to the operator. Afterwards, the program checks at S4 whether the time t5 has also exceeded the second time limit tLi2. If this is not the case, the program continues at S6. If the second time limit tLi2 was also exceeded, then at S5 the red alarm is set. Subsequently, at S6 the program checks, by means of the engine stop signal Mst, whether the internal combustion engine is stopped. If the signal engine stop Mst is not set, then the program returns to the main program of FIG. 6 at point A. If the engine stop signal Mst is set, then at S7 the identifier3 is set to a value of identifier3=0, and the program returns to the main program of FIG. 6 at point A.

Figure 8:
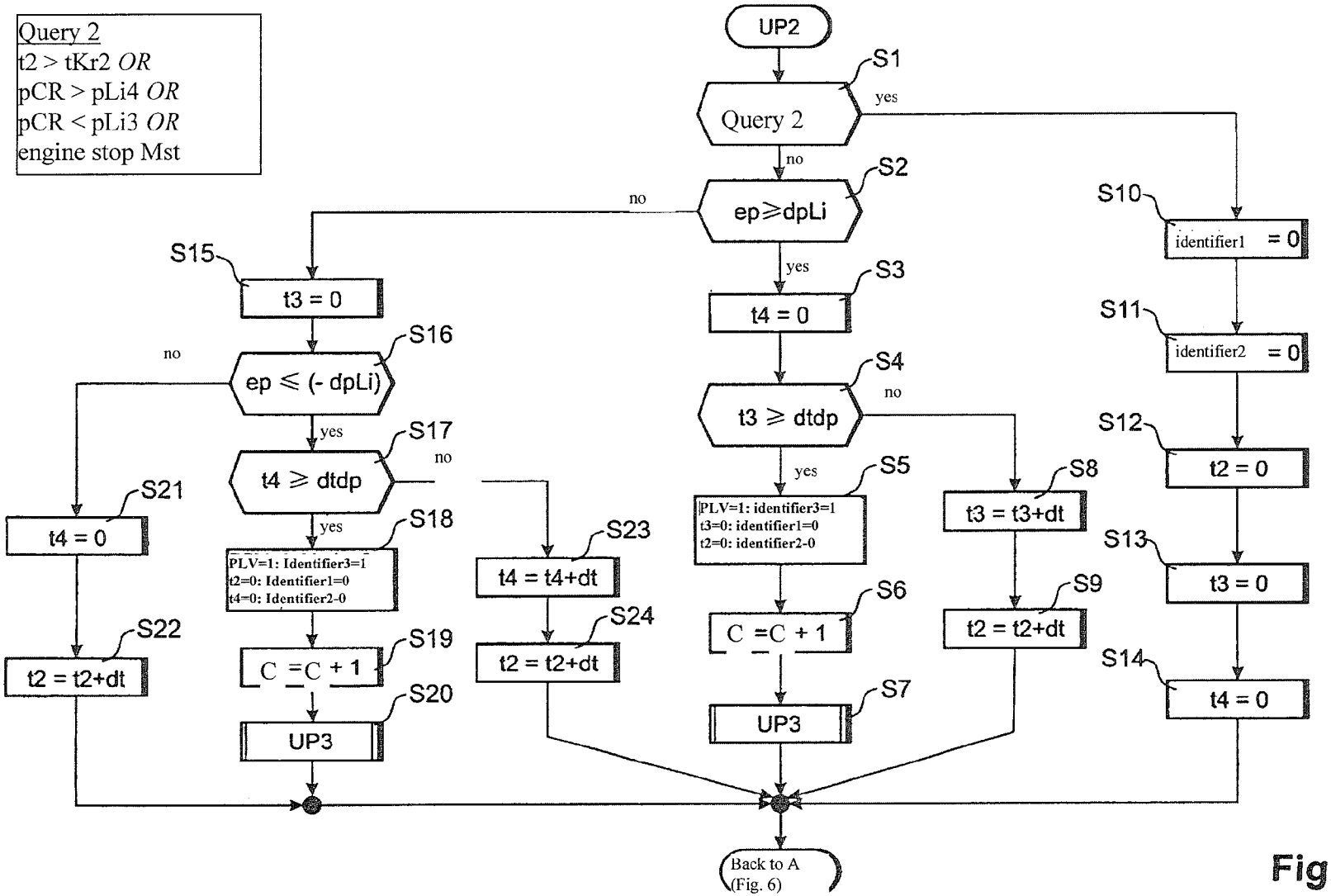

The second subroutine UP2 is depicted in FIG. 8, according to an exemplary approach. The second subroutine UP2 may be called up, for example, when, in the main program of FIG. 6 it is determined at S2 that the identifier2 is set (identifier2=1). If said identifier is set, then the monitoring method has two stages, wherein the first stage has already been successfully executed. At S1, the program checks in a query 2 whether the time t2 exceeds the second critical time tKr2, or whether the rail pressure pCR exceeds a fourth threshold value pLi4, or whether the rail pressure pCR falls below a third threshold value pLi3, or whether an engine stop (Mst=1) is detected. If one of these conditions is satisfied at S1 (i.e., query result S1:yes), then the method is aborted, i.e. in this case an open pressure limiting valve is not detected. Subsequently, the following are then reset to a value of 0: identifier) at S10, identifier2 at S11, and the time t2 at S12. The time t3 and the time t4, which indicate how long the absolute value of the rail pressure control deviation was steadily greater than the threshold value dpLi, are reset to a value of 0 at S13 and S14. If none of the above-mentioned conditions are fulfilled (i.e., query result S1:no), then at S2 the program checks whether the rail pressure control deviation ep is greater than or equal to the threshold value dpLi. If this is the case, then the time t4 is reset to a value of 0 at S3. This time t4 measures how long the rail pressure control deviation ep is steadily negative and the absolute value is greater than the threshold value dpLi. In contrast, the time t3 measures how long the rail pressure control deviation is steadily positive and greater than the threshold value dpLi. If time t3 reaches the threshold value dtdp (i.e., query result S4:yes), then an open pressure limiting valve is detected. At S5, the variable PLV (see FIG. 4) is set to a value of 1. Likewise at S5 the identifier1 and identifier2 as well as the time t2 and the time t3 are reset to a value of 0. The identifier3, which corresponds to the process variable PLV, is set to the value of identifier3=1. The counter C is incremented at S6, and subsequently checked at S7 in the third subroutine UP3 for a threshold value violation. Afterwards, the program branches into the main program of FIG. 6 at point A. If at S4 the program detects that the time t3 is smaller than the threshold value dtdp (i.e., query result S4:no), then at S8 the time t3 is incremented and at S9 the time t2 is incremented, and the program branches into the main program of FIG. 6 at point A.

If it is determined at S2 that the rail pressure control deviation ep is less than the threshold value dpLi (i.e., query response S2:no), then at S15 the time t3 is reset to a value of 0. Subsequently, the program checks at S16 whether the rail pressure control deviation ep is less than or equal to dpLi. If this is not the case (i.e., query result S16:no), then at S21 the time t4 is reset to a value of 0, and at S22 the time t12 is incremented. If, in contrast, the condition at S16 is fulfilled (i.e., query result S16:yes), then at S17 the program checks whether the time t4 is greater than or equal to the threshold value dtdp. If this is not the case (i.e., query result S17:no), then at S23 the time t4 and at S24 the time t2 are incremented. Afterwards, the program branches into the main program of FIG. 6 at point A. If at S17 it is determined that the time t4 is greater than/equal to the threshold value dtdp, then at S18 an open pressure limiting valve is detected and the variable PLV is set to a value of 1. Likewise at S18, the identifier1 and identifier2 as well as the time t2 and time t4 are reset to a value of 0 and identifier3 is set to a value of 1. At S19, the counter C is incremented and at S20 in the third subroutine UP3 (FIG. 9), the counter C is checked for threshold value violation. Afterwards, the program branches into the main program of FIG. 6 at point A.

Figure 9:
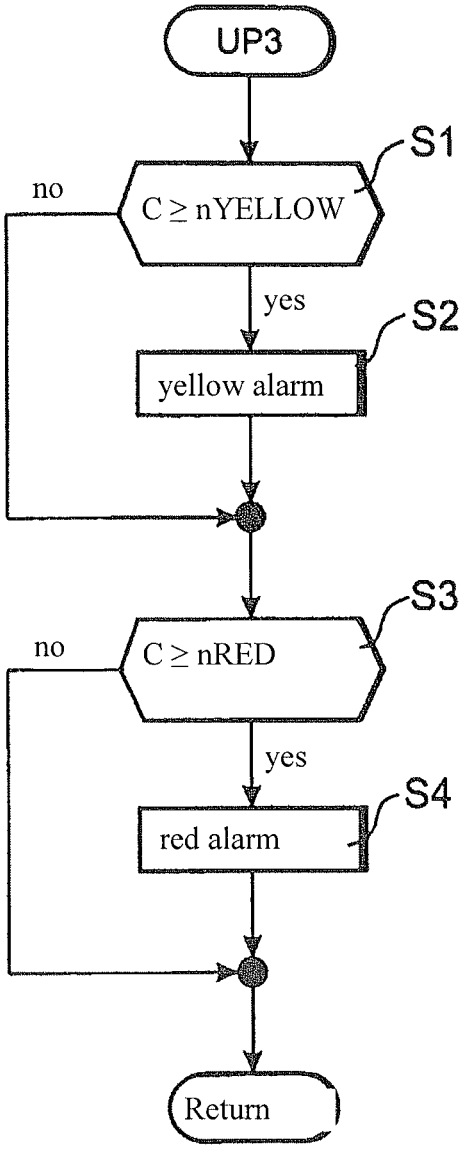

The third subroutine UP3 is depicted in FIG. 9, via which subroutine the counter C may be checked. The counter may then always be incremented when an open pressure limiting valve is detected. At S1, the program checks whether the counter C is greater than/equal to a predefined number nYELLOW, for example 30. If this is not the case, then it continues to S3. Otherwise, if the query response S1 is yes, then at S2 the yellow alarm is initiated to warn the operator. Subsequently, at S3 the program checks whether the counter C is greater than/equal to a predefined number nRED, for example 50. If this is not the case, then the subroutine is ended. If, in contrast, the counter is greater than/equal to nRED, then at S4 a red alarm is intimated. The red alarm indicates to the operator that the pressure limiting valve should have been replaced. Afterwards, the subroutine is ended.

The invention claimed is:

1. Method for controlling and regulating an internal combustion engine having a common rail system and having a passive pressure limiting valve for discharging fuel out of a rail into the fuel tank, in which method in a first stage, the pressure limiting valve is then set as open if, within a first critical time, proceeding from a steady-state rail pressure, the rail pressure exceeds a first threshold value and subsequently falls below a second threshold value, wherein the first threshold value characterizes a higher pressure level than the steady-state rail pressure, and the second threshold value characterizes a lower pressure level than the first threshold value, and in which method the opening duration of the pressure limiting valve is monitored.

2. Method according to claim 1
characterized in that
the opening duration is monitored in that a first time limit is determined by setting an open pressure limiting valve, and a second time limit determined for further operation, upon timeout of the first time limit, a yellow alarm for warning the operator is initiated, and after timeout of the second time limit, a red alarm is initiated as a recommendation to replace the pressure limiting valve.

3. Method according to claim 2,
characterized in that
the first critical time is set upon exceeding the first threshold value.

4. Method according to claim 3
characterized in that
the opening duration is stored upon detecting a stopped internal combustion engine.

5. Method according to claim 4
characterized in that
after a restart of the internal combustion engine, the saved opening duration continues to be counted, if the pressure limiting valve is again set as open during normal operation and the opening duration of the pressure limiting valve is monitored.

6. Method according to claim 1
characterized in that
the pressure limiting valve is set as open if, after a positively detected first stage, an absolute value of the rail pressure control deviation greater than/equal to a threshold value is detected without interruption within a second critical time in a second stage.

7. Method according to claim 1 or 6,
characterized in that
the frequency of the opening procedures is also detected supplementally to monitoring the opening duration.

8. Method according to claim 7,
characterized in that
a yellow alarm is initiated for a first number of opening procedures, and
a red alarm is initiated for a second number of opening procedures.

9. Method according to claim 1, wherein the second threshold value is a lower pressure level than the steady-state rail pressure.

10. Method according to claim 1, further comprising providing a handling recommendation regarding the pressure limiting valve from the opening duration of the pressure limiting valve.

11. Method according to claim 10, further comprising:
receiving an indication of a restart of the internal combustion engine; and
determining the handling recommendation based upon at least a saved opening duration of the pressure limiting valve occurring prior to the restart of the internal combustion engine.

12. Method according to claim 10, wherein the handling recommendation includes one of a warning and a replacement recommendation.

13. A method of controlling an internal combustion engine having a common rail system and having a passive pressure limiting valve for discharging fuel out of a rail into the fuel tank, the method comprising:
setting the pressure limiting valve as open if, within a first time period, the rail pressure increases from a steady-state rail pressure and exceeds a first threshold value, and subsequently falls below a second threshold value, wherein the second threshold value is a lower pressure level than the first threshold value, and monitoring an opening duration of the pressure limiting valve.

14. The method of claim 13, wherein the second threshold value is a lower pressure level than the steady-state rail pressure.

15. The method of claim 13, further comprising providing a handling recommendation regarding the pressure limiting valve from the opening duration of the pressure limiting valve.

16. The method of claim 15, further comprising:

receiving an indication of a restart of the internal combustion engine; and determining the handling recommendation based upon at least a saved opening duration of the pressure limiting valve occurring prior to the restart of the internal combustion engine.

17. The method of claim 15, wherein the handling recommendation includes one of a warning and a replacement recommendation.

* * * * *